US005524767A

United States Patent [19]

Kumagai et al.

[11] Patent Number: 5,524,767

[45] Date of Patent: Jun. 11, 1996

[54] DRY FLUIDIZED BED SORTING DEVICE

[75] Inventors: Masakatsu Kumagai, Aichi-ken; Yoshihisa Fujita, Saitama-ken, both of Japan

[73] Assignees: Toyota Tsusho Corporation; Toyota Metal Co., Ltd., both of Nagoya; Senko Kogyo Co., Ltd., Tokyo, all of Japan

[21] Appl. No.: 219,360

[22] Filed: Mar. 29, 1994

[30] Foreign Application Priority Data

Mar. 31, 1993 [JP] Japan ..... 5-098642

[51] Int. Cl.[6] ..... B07B 13/00

[52] U.S. Cl. ..... 209/44; 209/479; 209/490; 209/506

[58] Field of Search ..... 209/44, 466, 471, 209/479, 490, 494, 506

[56] References Cited

U.S. PATENT DOCUMENTS

| | | | |
|---|---|---|---|
| 1,548,536 | 8/1925 | Macartney | 209/479 X |
| 2,091,620 | 8/1937 | Williams | 209/44 X |
| 2,740,526 | 4/1956 | Spiller | 209/490 X |
| 3,472,379 | 10/1969 | Lainas et al. | 209/479 |
| 3,950,246 | 4/1976 | Klefisch | 209/44 |
| 4,673,492 | 6/1987 | Jasinski | 209/506 X |
| 5,087,351 | 2/1992 | Valentine, Sr. | 209/490 X |

FOREIGN PATENT DOCUMENTS

| | | | |
|---|---|---|---|
| 58-282 | 1/1983 | Japan . | |
| 58-19337 | 2/1983 | Japan . | |
| 62-186957 | 8/1987 | Japan . | |
| 277817 | 9/1927 | United Kingdom | 209/479 |
| 483815 | 4/1938 | United Kingdom | 209/506 |

*Primary Examiner*—Joseph E. Valenza
*Assistant Examiner*—Tuan Nguyen
*Attorney, Agent, or Firm*—Oblon, Spivak, McClelland, Maier & Neustadt

[57] ABSTRACT

A dry fluidized bed sorting device comprises a sorting deck arranged with an inclination to make a vibrating motion and continuously supplied with a fluidized bed used as media, while being supplied with materials to be sorted, a large number of separation promoting pieces planted on the bottom of the sorting deck and bent to the downstream side, and a separation plate arranged at a boundary portion for separating the materials to be sorted into deposits and flotages and located on the downstream side of the sorting deck.

20 Claims, 9 Drawing Sheets

DRY FLUIDIZED BED SORTING DEVICE

BACKGROUND OF THE INVENTION

1. Field of the Invention

This invention relates to a dry fluidized bed sorting device provided with J-shaped separation promoting pieces to be adapted to prevent loop-like materials from being caught, while effectively separating and sorting materials to be sorted, in an apparatus for sorting the materials to be sorted by causing the materials to be sorted to settle down or float through a fluidized bed used as media according to the size in specific gravity of the materials to be sorted relative to the fluidized bed. The terms "fluidized bed" and "fluidizing media" are utilized herein to connote the use of a fluidizing media which acts as a fluid in that the fluidizing media assists in suspending and transporting materials during sorting. In a preferred form of the invention, the fluidizing media is a particulate material, for example, sand.

2. Description of the Prior Art

As shown in FIG. 9, a conventional dry solid matter sorting device (See Japanese Patent Publication No. 58-19337) has been constituted such that a large number of screening assistant members composed of straight rod bodies B, rectangular plate bodies P or screw rods S are planted on a bottom plate T of a sorting trough F.

In the conventional device described above, the screening assistant members composed of the straight rod bodies B, the rectangular plate bodies P or the screw rods S are vertically planted on the bottom plate T. Therefore, when the materials to be sorted contain loop-like materials R such as wire harnesses and washers, the loop-like materials R are caught by the screening assistant members just as quoits, and thus it involves such problems that the flow resistance within the sorting through is increased to result in the reduction of a sorting quantity per unit time, not to mention the reduction of a screening assistant function.

SUMMARY OF THE INVENTION

An object of the present invention is to prevent loop-like materials contained in materials to be sorted from being caught by separation promoting pieces.

Another object of the present invention is to prevent the separating function of separation promoting pieces from reducing.

A further object of the present invention is to prevent the flow resistance within a sorting deck from increasing.

A still further object of the present invention is to promote the separation of deposits and the floating of flotages.

A yet further object of the present invention is to provide a dry fluidized bed sorting device having separation promoting pieces planted on the bottom of a sorting deck and bent to the downstream side.

A yet further object of the present invention is to provide a dry fluidized bed sorting device comprising a sorting deck arranged with an inclination to make a vibrating motion and continuously supplied with a fluidized bed used as media, while being supplied with materials to be sorted; a large number of J-shaped separation promoting pieces planted on the bottom of the sorting deck and bent to the downstream side; and a separation plate arranged on a downstream portion of the sorting deck at a certain height to be in approximately parallel to the bottom and for separating the materials to be sorted into deposits and flotages.

A yet further object of the present invention is to provide a dry fluidized bed sorting device constituted such that the distance between the vertical opposite walls on both downstream sides of the sorting deck in the width direction is gradually narrowed.

A yet further object of the present invention is to provide a dry fluidized bed sorting device constituted such that the number of separation promoting pieces located on the downstream side of the sorting deck having the narrow distance between the opposite walls is made smaller than that of separation promoting pieces located on the upstream side of the sorting deck.

A yet further object of the present invention is to provide a dry fluidized bed sorting device constituted such that the tip end of the separation plate is arranged with an inclination to a line normal to the longitudinal axis of the sorting deck.

A yet further object of the present invention is to provide a dry fluidized bed sorting device constituted such that the upstream-side end portion of the separation plate is formed to have a circular section.

Since a large number of separation promoting pieces planted on the bottom of the sorting deck are respectively bent to the downstream side to take the shape of J letter, the dry fluidized bed sorting device of the present invention described above is adapted to prevent loop-like materials from being caught by the separation promoting pieces, even when the materials to be sorted contain the loop-like materials.

Since the distance between the vertical opposite walls on both downstream sides of the sorting deck in the width direction is gradually reduced, the fluidized bed is thickened to enlarge the difference in height between the deposits and the flotages, and thus dry fluidized bed sorting device of the present invention described above is adapted to surely carry out the separating operation.

Since the tip end of the separation plate is arranged with an inclination, the dry fluidized bed sorting device of the present invention described above is less liable to produce the deviation due to the abrasion even by the use for a long period of time.

Since the upstream-side end portion of the separation plate is formed to have a circular section, the dry fluidized bed sorting device of the present invention described above effectively realizes the splitting of the fluidized bed to prevent the loop-like materials from being caught, and is also adapted to easily release the loop-like materials, even if the loop-like materials are caught.

The dry fluidized bed sorting device of the present invention having the operation described above has the effect of preventing the loop-like materials from being caught to prevent both the reduction of the separating function and the increase of the flow resistance, since each separation promoting piece is formed to take the shape of J letter.

The dry fluidized bed sorting device of the present invention having the operation described above has the effect of surely separating the materials to be sorted into the deposits and the flotages by narrowing the width on the downstream side, while preventing the increase of the flow resistance, since the number of the separation promoting pieces on the downstream side is reduced.

The dry fluidized bed sorting device of the present invention having the operation described above has the effect of lengthening the life of the separation plate, since the tip end of the separation plate is inclined in advance to taken a large abrasion width.

The dry fluidized bed sorting device of the present invention having the operation described above has the effect of preventing both the increase of the flow resistance and the reduction of a sorting quantity per unit time, since the loop-like materials are prevented from being caught by the end portion of the separation plate.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
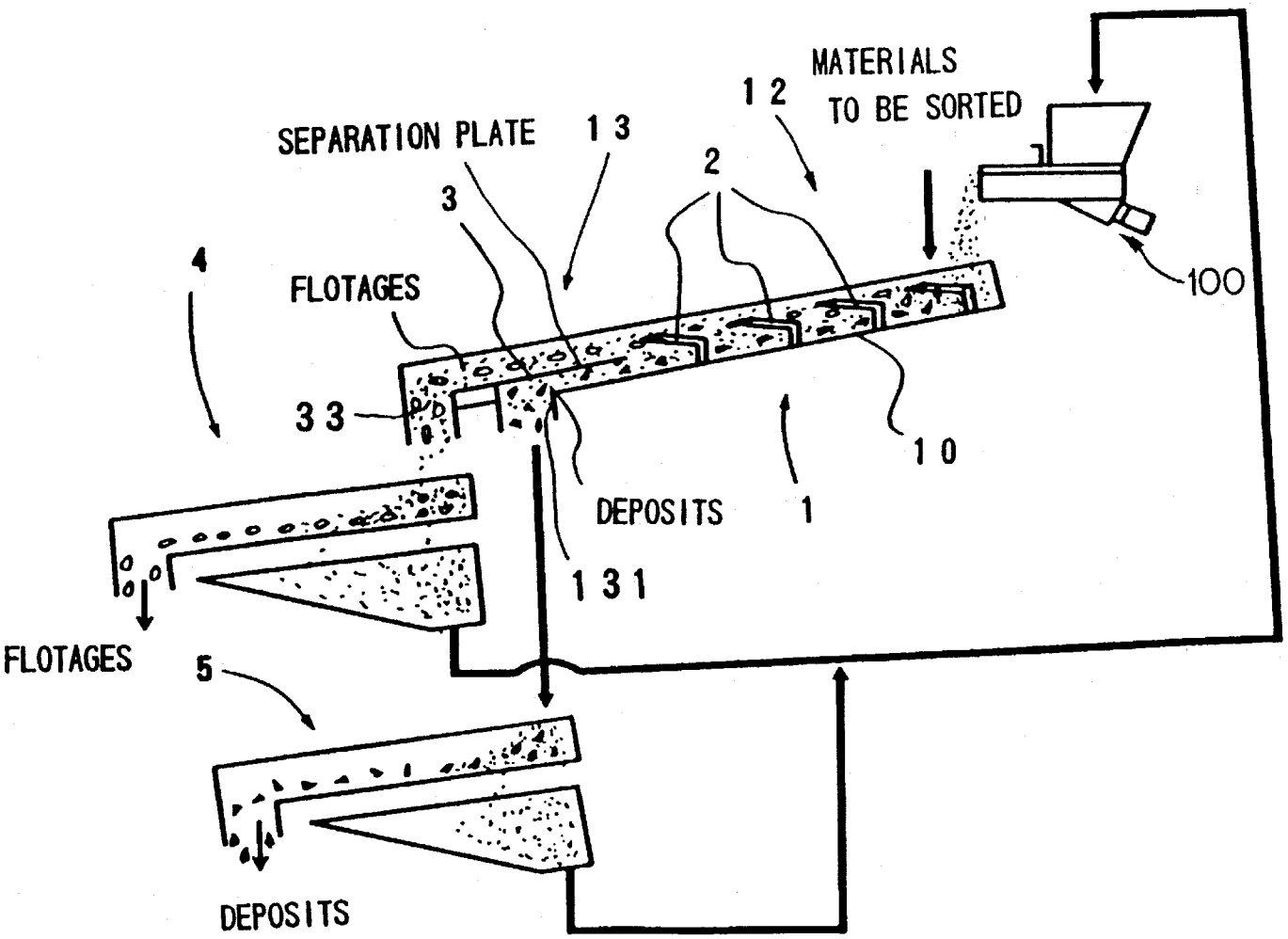
FIG. 1 is a block diagram showing the overall constitution of a dry fluidized bed sorting device as a first preferred embodiment of the present invention.
Figure 2:
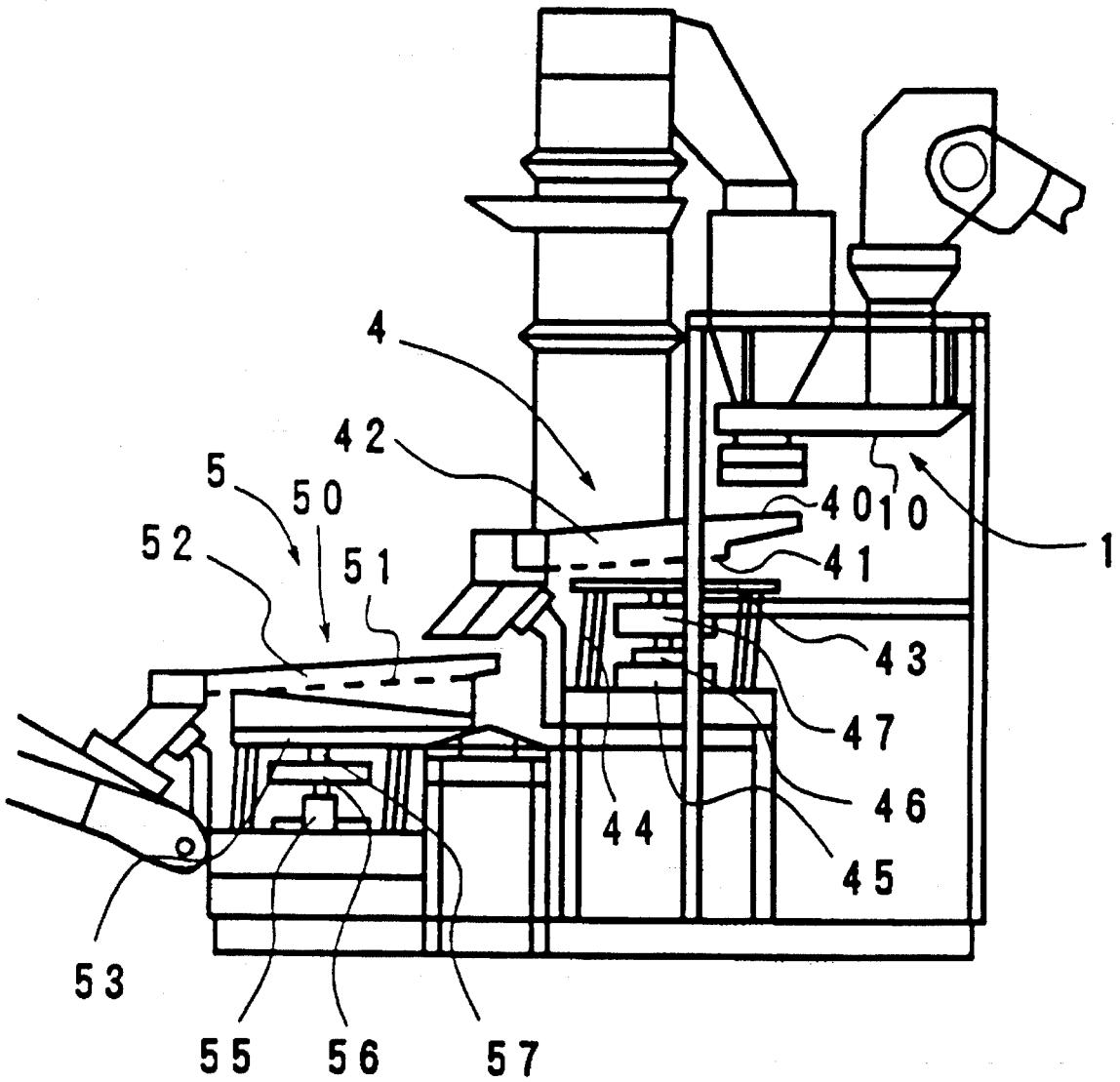
FIG. 2 is a side view showing the overall constitution of the dry fluidized bed sorting device as the first preferred embodiment of the present invention.

As shown in FIGS. 1 to 4, a dry fluidized bed sorting device as a first preferred embodiment of the present invention comprises a sorting deck 1 arranged with an inclination to make an eccentric motion as a vibrating motion and continuously circulated and supplied (by a supply device or fluidizing media supply means represented at 100 in FIG. 1) with sand constituting a fluidized bed of a sandy medium used as a media, while being supplied with nonferrous materials as materials to be sorted such as, for example, crushed pieces of automobiles containing loop-like materials such as cut pieces of wire harnesses, a large number of J or V-shaped separation promoting pieces 2 planted on a bottom 10 of the sorting deck 1 in rows and bent to the downstream side, and a separation plate 3 arranged on a downstream portion of the sorting deck 1 at a certain height to be in approximately parallel to the bottom and for separating the materials to be sorted into deposits and flotages according to the size in specific gravity of the materials to be sorted relative to the fluidized bed.

Figure 3:
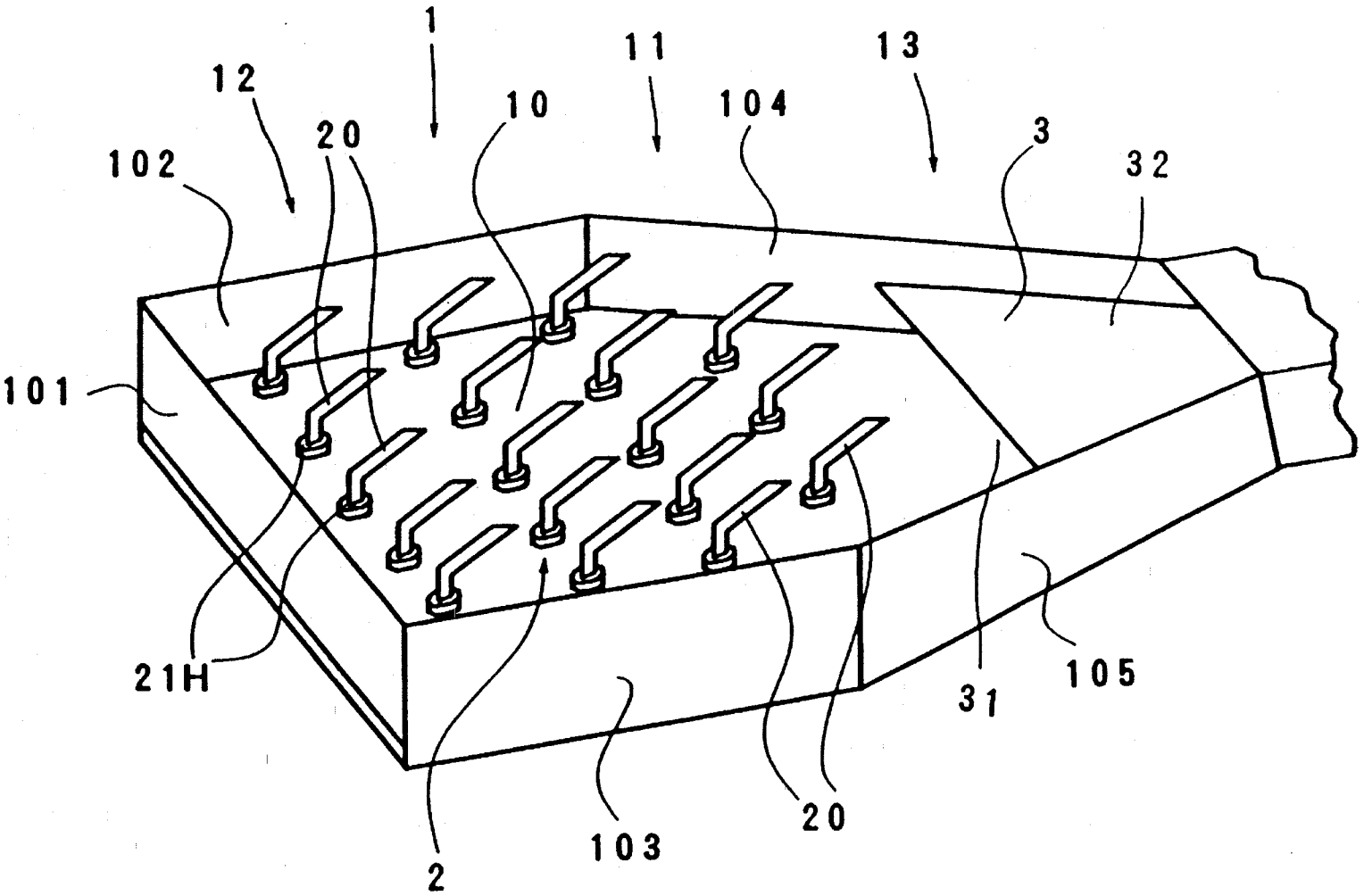
FIG. 3 is a perspective view showing an essential portion of the dry fluidized bed sorting device as the first preferred embodiment of the present invention.

As shown in FIG. 3, the sorting deck 1 is constituted by a case body 11 formed by joining vertical plates together along upstream and downstream ends and widthwise opposite portions of an approximately hexagonal bottom plate 10 made of stainless steel. The case body 11 is composed of an upstream-side rectangular case body portion 12 having a certain width and formed by joining vertical plates 101, 102 and 103 together along three sides of the bottom plate 10 to have an open top face, and a downstream-side trapezoidal case body portion 13 formed by joining vertical plates 104 and 105 together along the gradually-tapered widthwise opposite ends and the downstream end of the bottom plate 10.

An opening 131 is formed in a portion of the downstream-side trapezoidal case body portion 13 close to the downstream end of the bottom plate 10 so as to make it possible to discharge deposits containing heavy components as will be described later.

Figure 4:
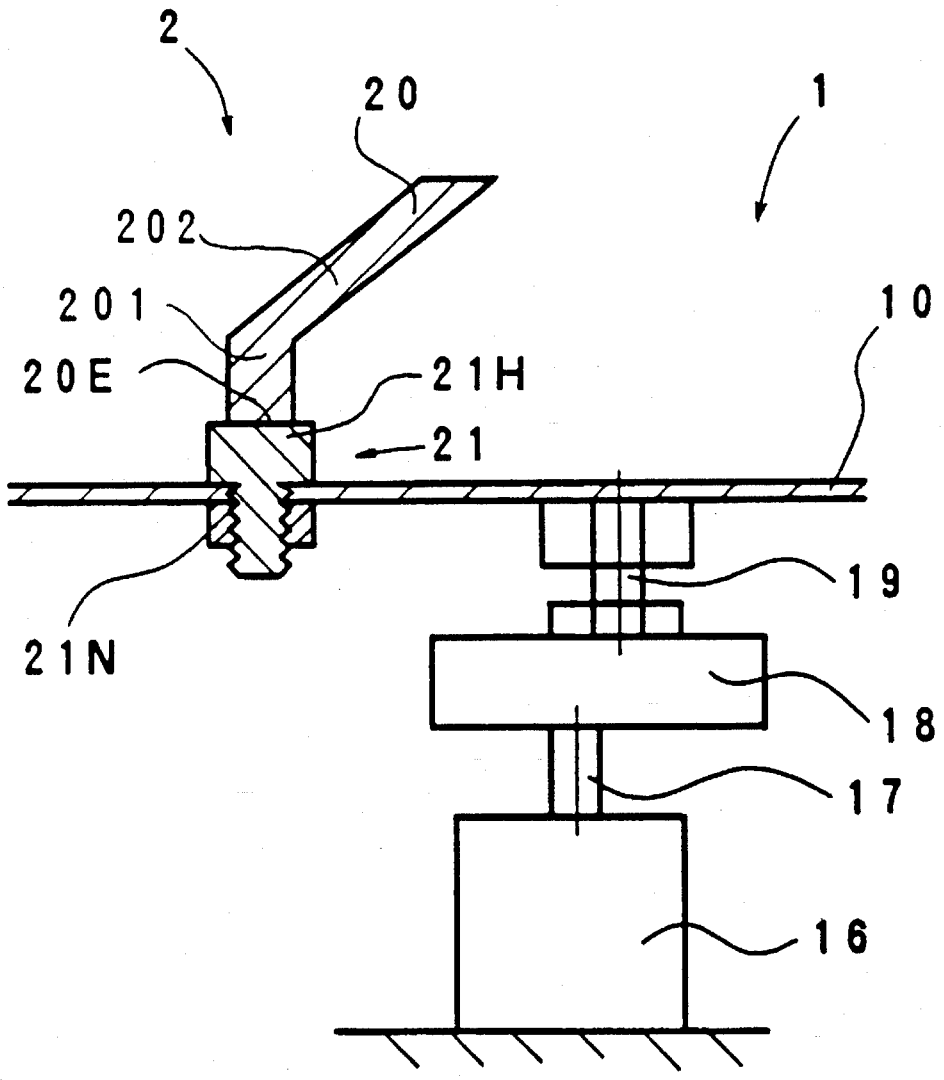
FIG. 4 is a sectional view showing a separation promoting piece and a vibrating device of the dry fluidized bed sorting device as the first preferred embodiment of the present invention.

The sorting deck 1 is supported at four portions by springs arranged above, and an eccentric motion is applied as a vibrating motion to the sorting deck 1 through a connecting rod 19 having one end anchored to a part of a rotary disc 18 fixedly attached to a rotary shaft 17 of a motor 16 and the other end anchored to the underside of the sorting deck, as shown in FIG. 4.

Each separation promoting piece 2 is constituted by an approximately J or V-shaped stainless steel plate 20 bent to the downstream side of the sorting deck 1 and composed of a vertical portion 201 fixedly attached to the bottom plate 10 of the sorting deck 1 and an extended portion 202 extending from the vertical portion obliquely upwards. As shown in FIG. 3, the separation promoting pieces 2 are arranged on the bottom plate 10 of the sorting deck 1 in rows. Further, as shown in FIG. 4, in each J-shaped stainless steel plate 20, a lower end 20E of the vertical portion 201 is integrally fixed to a head 21H of a bolt 21 passed through the bottom plate 10, and the bolt 21 is integrally fixed to the bottom plate 10 of the sorting deck 1 by a nut 21N from the underside of the bottom plate 10.

In the upstream-side rectangular case body portion 12 of the sorting deck 1, five pieces of the J-shaped stainless steel plates 20 are lined up in the width direction and arranged in three rows in the longitudinal direction, while in the downstream-side trapezoidal case body portion 13, three pieces of the J-shaped stainless steel plates 20 are lined up in the width direction and arranged only in a row.

The separation plate 3 is arranged in parallel to the bottom plate 10 placed with a boundary portion between the deposits and the flotages and at a height of approximately two third of each separation promoting piece 2 from the bottom plate 10 so as to extend from a central portion of the downstream-side trapezoidal case body portion 13 to the downstream end of the sorting deck 1, so that the separation plate 3 partitions a portion of the sorting deck 1 in the range of the central portion of the downstream-side trapezoidal case body portion 13 to the downstream end into a lower passage 31 for allowing the deposits to pass through and an upper passage 32 for allowing the flotages to pass through. Further, an opening 33 for supplying the flotages is formed in a downstream end portion of the separation plate 3.

A first screening device 4 is adapted to recover sand from the flotages and arranged below the opening 33 of the separation plate 3. The first screening device 4 is constituted by a case body 40 arranged with an inclination and composed of a screen 41 arranged on the bottom and having holes of a size enough to allow the sand constituting the fluidized bed to pass through and a side wall 42 constituted by a metal plate. Further, a medium recovery trough 43 for recovering the sand constituting the fluidized bed is arranged below the case body 40.

The first screening device 4 is supported by coil springs 44 at four portions on the underside of the case body 40 and the medium recovery trough 43, while being anchored by a connecting member 47 to a position offset from the axial center of a disc 46 rotationally driven by a motor 45, so that an eccentric motion is applied as a vibrating motion to the first screening device 4 correspondingly to the rotation of the motor 45.

A second screening device 5 is adapted to recovery sand from the deposits and communicated to the opening 131 formed in the downstream end portion of the bottom plate 10 of the sorting deck 1. The second device 5 is constituted by a case body 50 arranged with an inclination and composed of a screen 51 arranged on the bottom and having holes of a size enough to allow the sand constituting the fluidized bed to pass through and a side wall 52 constituted by a metal plate. Further, a medium recovery trough 53 for recovering the sand constituting the fluidized bed is arranged below the case body 50.

The second screening device 5 is supported by coil springs at four portions on the underside of the case body 50 and the medium recovery trough 53, while being anchored by a connecting member 57 to a position offset from the axial center of a disc 57 rotationally driven by a motor 55, so that an eccentric motion is applied as a vibrating motion to the second screening device 5 correspondingly to the rotation of the motor 55.

According to the dry fluidized bed sorting device as the first preferred embodiment constituted as described above, the sand constituting the fluidized bed used as media is recovered by the medium recovery troughs 43 and 53 into the sorting deck 1 arranged with an inclination to make an eccentric motion, and then materials to be sorted consisting of nonferrous materials containing loop-like materials are supplied to the upstream-side rectangular case body portion 12 of the sorting deck 1 normally subjected to circulation, a circular motion is applied to both the sand and the materials to be sorted due to the eccentric motion of both the sorting deck 1 and the separation promoting pieces 2, and the materials heavier than the sand are settled downwards through the fluidized bed of the sand and then moved to the downstream.

At this time, when the materials heavier than the sand strike against each J-shaped stainless steel plate 20 of a plurality of separation promoting pieces 2, a gap is formed between the media and the materials heavier than the sand due to the vibration of the separation promoting pieces 2, so that the materials heavier than the sand are smoothly settled down along the side walls of the separation promoting pieces 2.

On the other hand, since aluminum or like materials lighter than the sand used as media are not settled down through the sand used as media, such light materials are floated through the sand used as media and then moved to the downstream along the upper part of the sorting deck.

The materials reaching the separation plate 3 in the downstream-side trapezoidal case body portion 13 through the settlement and floating within the sorting deck 1 are separated by the separation plate 3 into the deposits such as copper, zinc and brass materials and the flotages such as aluminum materials. The deposits and flotages thus separated are supplied respectively to the second and first screening devices 5 and 4 through the openings 131 and 33.

The first screening device 4 sifts the flotages containing the aluminum materials or the like by the vibrated case body 40 provided with the screen 41, and then drops only the sand used as media in order to circulate the sand to the upstream, while supplying the remaining aluminum materials or the like to the next steps.

The second screening device 5 sifts the deposits containing the copper, zinc and brass materials or the like by the vibrated case body 50 provided with the screen 51, and then drops only the sand used as media in order to circulate the sand to the upstream, while supplying the remaining copper, zinc and brass materials or the like to the next step.

The dry fluidized bed sorting device as the first preferred embodiment having the operation as described above has the effect of making it possible to sort out the aluminum materials or the like lighter than the sand of the fluidized bed used as media and the copper, zinc and brass materials or the like heavier than the sand. Further, since each separation promoting piece 2 for applying the vibration to both the fluidized bed and the materials to be sorted is constituted by the J-shaped stainless steel plate 20 bent to the downstream side and having a large surface area, the circular motion of both the media and the materials to be sorted can be promoted to promote the settlement of the deposits.

Furthermore, since each separation promoting piece 2 is formed to take the shape of J letter so that the extending portion 202 on the tip end side is bent to the downstream side and extended obliquely upwards to direct the tip end of each separation promoting piece 2 to the downstream side, the dry fluidized bed sorting device as the first preferred embodiment has the effect of preventing the loop-like materials contained in the materials to be sorted from being caught to prevent both the reduction of the separating function and the increase of the flow resistance.

Figure 5:
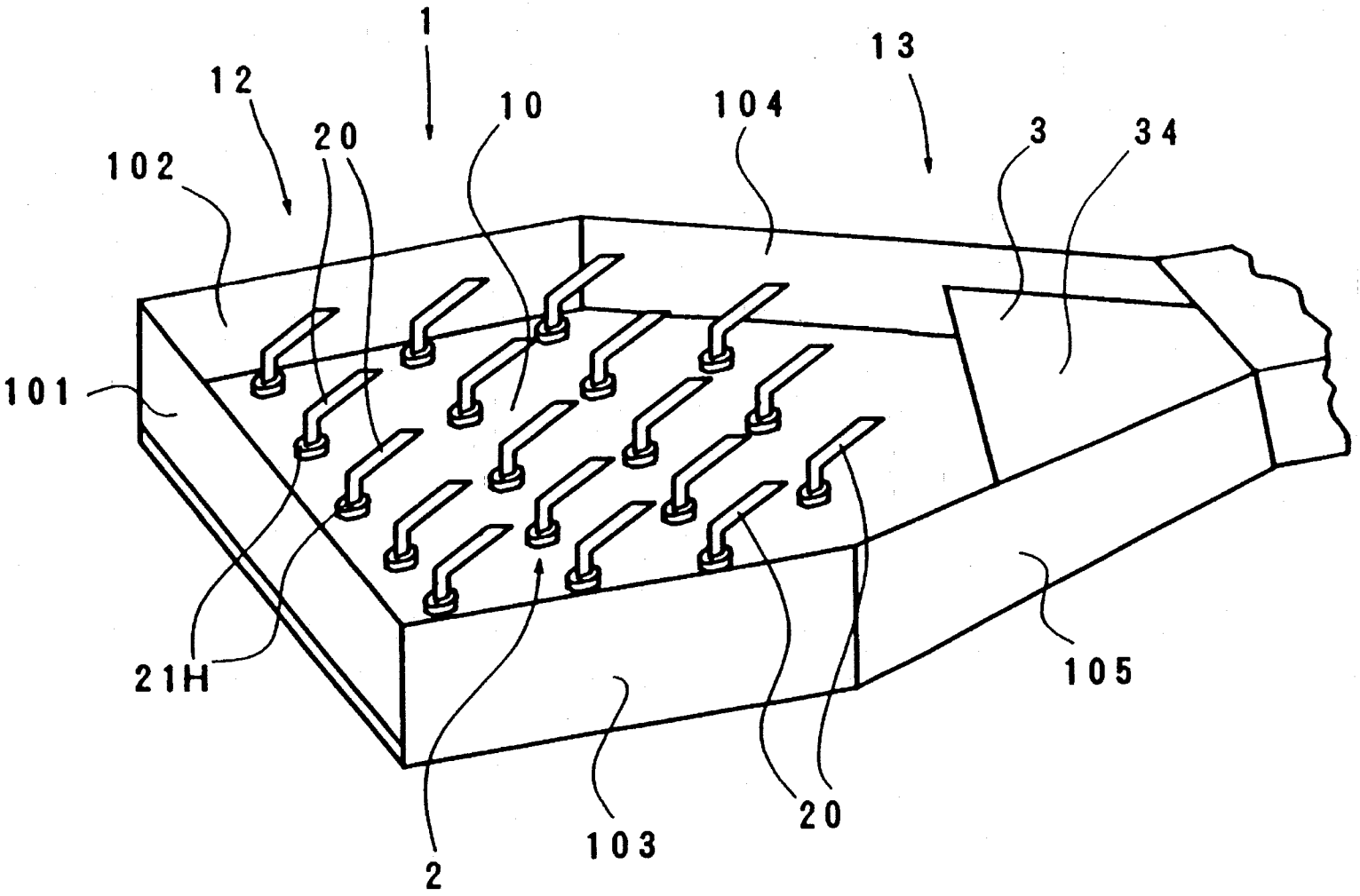
FIG. 5 is a perspective view showing an essential portion of a dry fluidized bed sorting device as a second preferred embodiment of the present invention.

A dry fluidized bed sorting device as a second preferred embodiment is different from the first preferred embodiment in only the separation plate 3 having an upstream-side end orthogonal to the longitudinal axis of the sorting deck 1 of the first preferred embodiment such that an upstream-side end 34 of the separation plate 3 is inclined to the longitudinal axis of the sorting deck 1 in consideration of the eccentric motion, as shown in FIG. 5. Thus, the dry fluidized bed sorting device as the second preferred embodiment has the effect of promoting the separating operation, while lengthening the lift of the sorting deck 1 by enlarging the abrasion width (on the underside in the drawing) of the upstream-side end of the separation plate 3 in consideration of the unsymmetrical abrasion due to the eccentric motion of the sorting deck 1.

Figure 6:
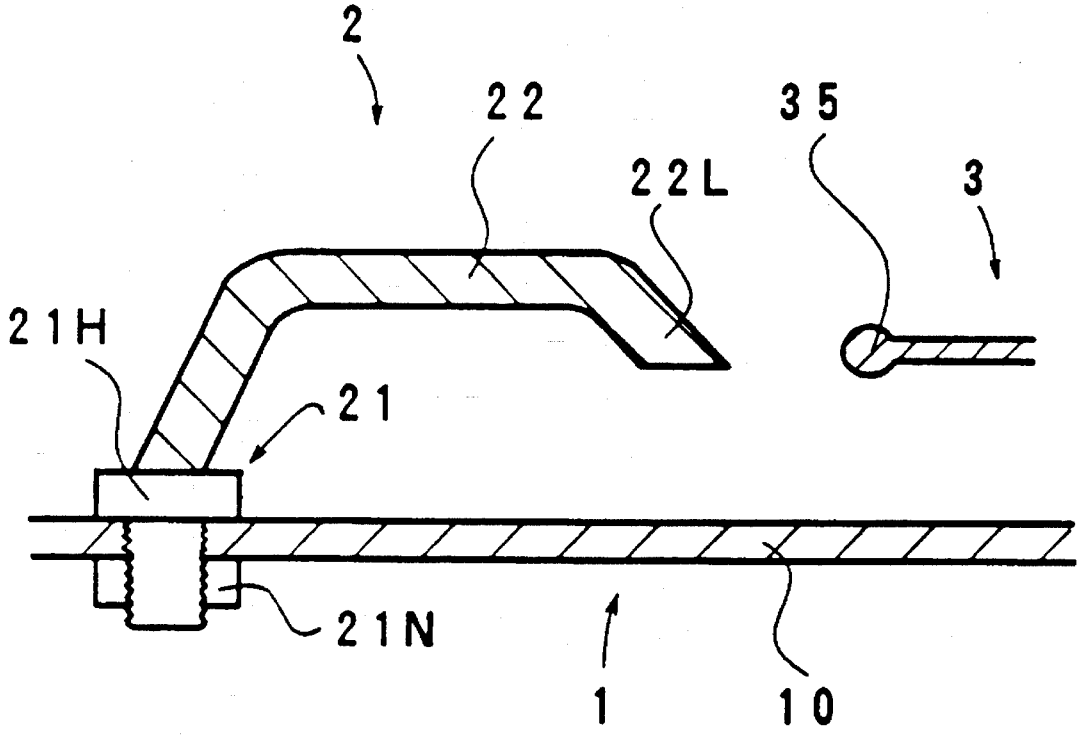
FIG. 6 is a sectional view showing an essential portion of a dry fluidized bed sorting device as a third preferred embodiment of the present invention.

A dry fluidized bed sorting device as a third preferred embodiment is different from the above preferred embodiments in that the upstream-side end portion of the separation plate 3 is formed in a circular end face 35 and each separation promoting piece 2 is constituted by a C-shaped member 22, as shown in FIG. 6. Thus, the dry fluidized bed sorting device as the third preferred embodiment has the effect of further facilitating the separating operation by varying the flow direction of the fluidized bed and the deposits from that of the fluidized bed and the flotages along the circular face due to the upstream-side circular end face 35 having a diameter larger than the thickness of the separation plate 3. Further, a downwardly bent portion 22L is formed on the tip end of each separation promoting piece 2, so that even if the loop-like materials are caught by the separation promoting pieces 2, such loop-like materials can be released from the separation promoting pieces by the operation of settling down the deposits.

Figure 7:
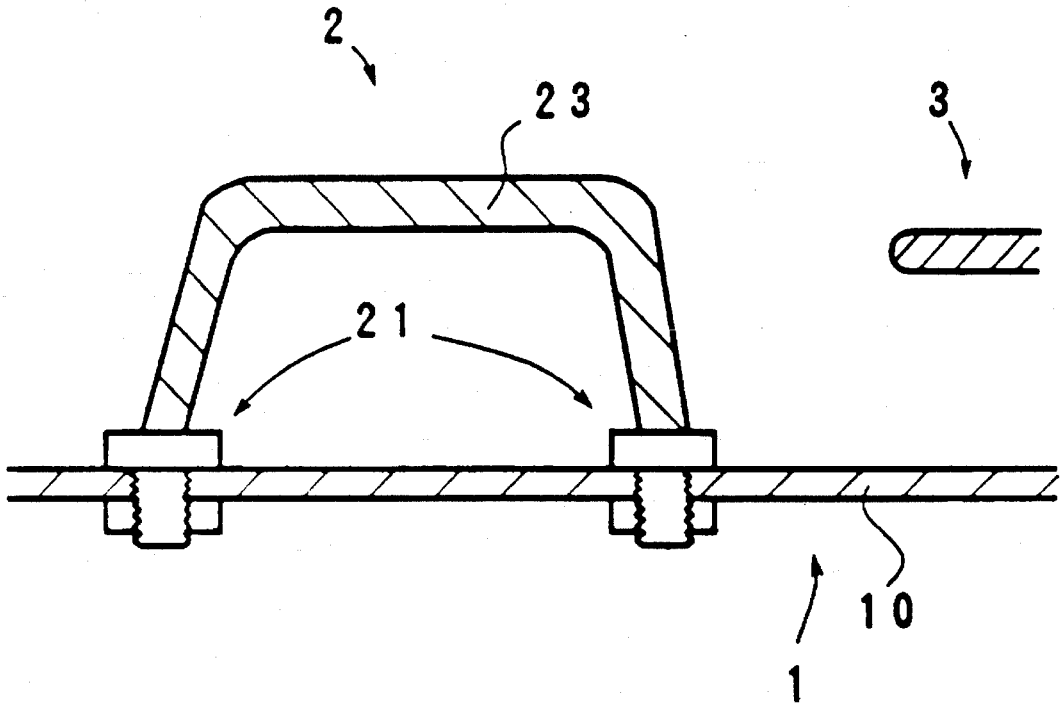
FIG. 7 is a sectional view showing an essential portion of a dry fluidized bed sorting device as a fourth preferred embodiment of the present invention.

A dry fluidized bed sorting device as a fourth preferred embodiment is different from the above preferred embodiments in that each separation promoting piece 2 is constituted by a channel-shaped member 23 having opposite ends spaced to be longer than each loop-like material and fixedly attached to the bottom plate 10 to take the shape of loop, as shown in FIG. 7. Thus, since each separation promoting piece 2 has no open end having a possibility of allowing the loop-like materials such as washers to enter thereinto as in the case of the first to third preferred embodiments, the dry fluidized bed sorting device as the fourth preferred embodiment has the effect of effectively preventing the loop-like materials from being caught, while promoting the operation of separating the deposits from the flotages due to the upstream-side circular end face of the separation plate 3 similarly to the case of the second preferred embodiment.

Figure 8:
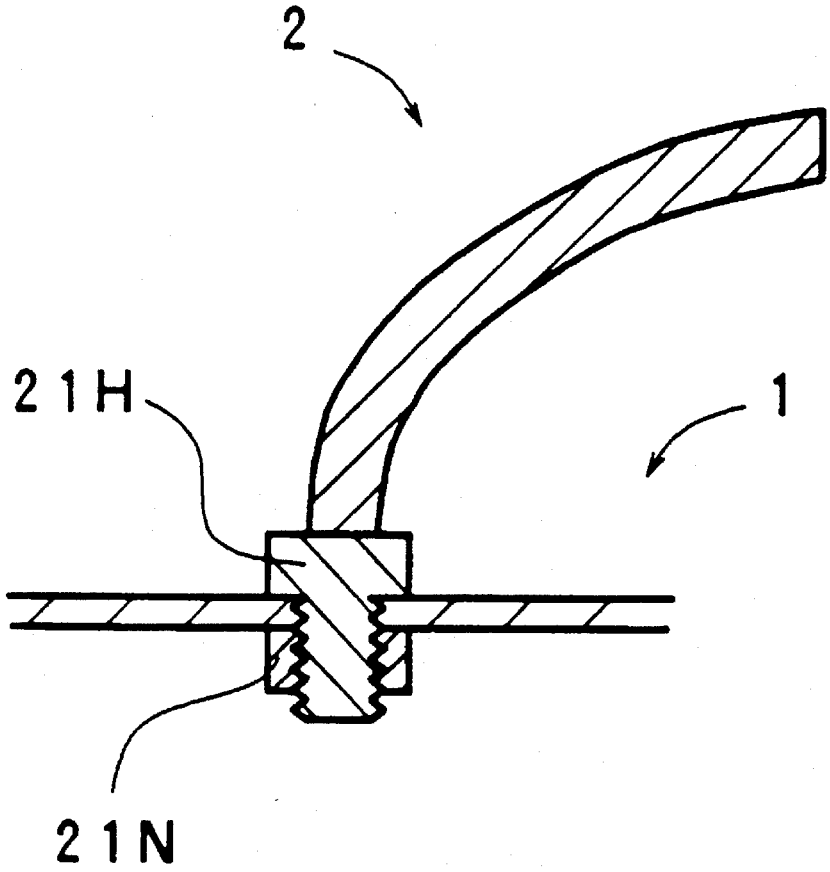
FIG. 8 is a sectional view showing a modification of a separation promoting piece.
Figure 9A:
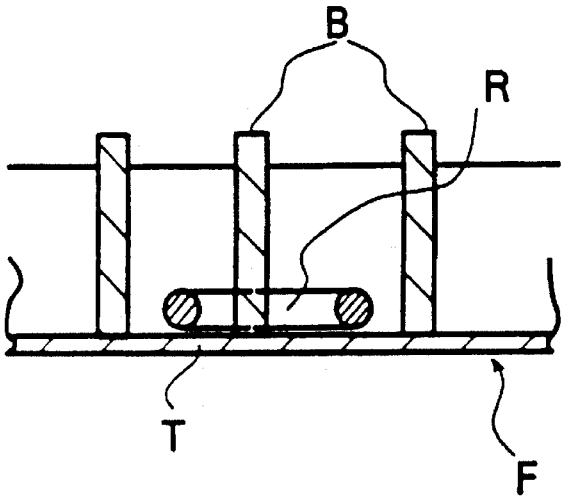
FIG. 9a (PRIOR ART)
FIG. 9 is a sectional view showing a screening assistant member in a prior art device.
Figure 9B:
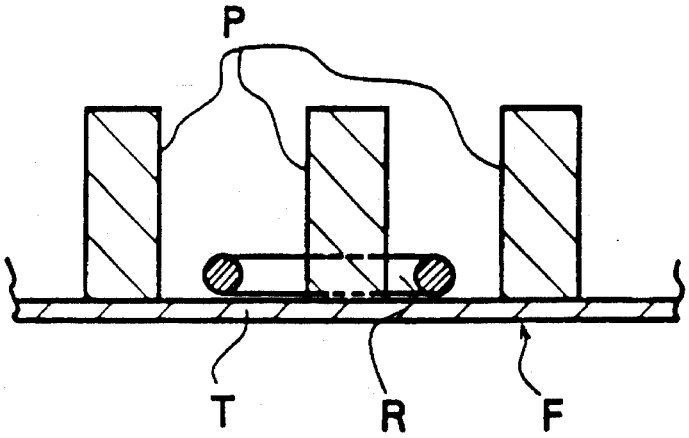
FIG. 9b (PRIOR ART)
Figure 9C:
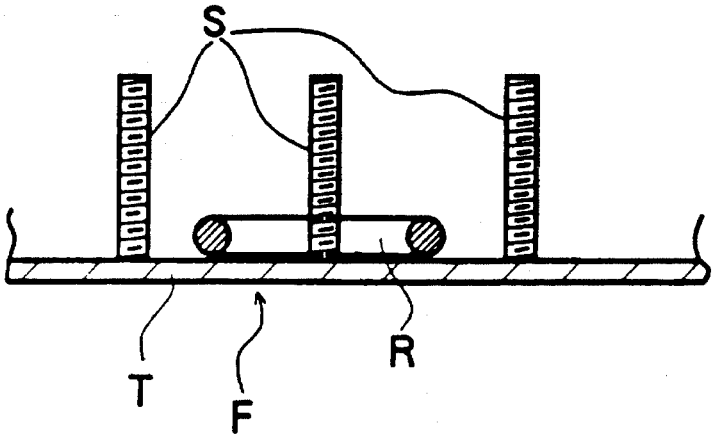
FIG. 9c (PRIOR ART)

The preferred embodiments described above are illustrative and not restrictive, and it is to be understood that other embodiments and modifications are possible without departing from the technical concept of the invention which will be recognized by those skilled in the art on the basis of the claims, the description of the invention and the drawings. The first preferred embodiment described above of using the nonferrous materials such as, for example, the crushed pieces of the automobiles as the materials to be sorted is illustrative and not restrictive, and it is to be understood that the present invention can be adapted to sort ferrous materials such as, for example, industrial wastes other than the automobiles, urban refuse and others. Additionally, the sand constituting the fluidized bed used as media can be replaced by converter air-crushed slag and others heavier than the sand in accordance with the kind of materials to be sorted. Some preferred embodiments described above of the separation promoting pieces are illustrative and not restrictive, and it is to be understood that an arched separation promoting piece or the like as shown in FIG. 8 and L-shaped separation promoting piece, for example, can be adopted.

What is claimed is:

1. A dry fluidized bed sorting device, comprising:

a sorting deck having a flat bottom arranged with an inclination to make a vibrating motion and including means for continuously supplying a fluidizing media to thereby provide a fluidized bed of a granular material flowing in a flow direction from an upstream side to a downstream side thereof, while being supplied with materials to be sorted according to a size in specific gravity thereof relative to the fluidized bed;

a plurality of separation promoting pieces planted at an interval in a width direction and said flow direction of said sorting deck on said flat bottom of said sorting deck and wherein said separation promoting pieces have two side surfaces and are bent toward the downstream side; and a separation plate arranged at a boundary portion for separating the materials to be sorted into deposits and flotages and located on the downstream side of the sorting deck.

2. A dry fluidized bed sorting device according to claim 1, wherein said plurality of separation promoting pieces have a width in a widthwise direction of said sorting deck which is substantially smaller than a width of said sorting deck, with said widthwise direction transverse to said flow direction, and wherein a plurality of said separation promoting pieces are disposed in said widthwise direction having a spacing between said separation promoting pieces disposed in said widthwise direction, such that said separation promoting pieces provide a plurality of projections planted on said bottom of said sorting deck.

3. A dry fluidized bed sorting device according to claim 2, wherein each separation promoting piece comprises a fixed portion fixedly attached to the bottom of said sorting deck and an extended portion extending from said fixed portion to the downstream side in the flow direction, and the fixed portion of said each separation promoting piece comprises a vertical fixed portion vertically extending upwards.

4. A dry fluidized bed sorting device according to claim 3, wherein the extended portion of said each separation promoting piece extends obliquely upwards.

5. A dry fluidized bed sorting device according to claim 4, wherein said each separation promoting piece is constituted by an approximately J-shaped plates member.

6. A dry fluidized bed sorting device according to claim 3, wherein the extended portion of said each separation promoting piece comprises a horizontal portion horizontally extending toward the downstream side and a bent portion bent downwards and extending from the horizontal portion at a downstream end of said horizontal portion.

7. A dry fluidized bed sorting device according to claim 3, wherein the extended portion of said each separation promoting piece comprises a horizontal portion horizontally extending toward the downstream side and a downward extended portion bent downwards from the horizontal portion at a downstream side of said horizontal portion, with the downward extended portion extending downwards and having a lower end fixedly attached to the bottom of said sorting deck.

8. A dry fluidized bed sorting device according to claim 1, wherein a distance between vertical opposite walls on both sides of said sorting deck in a width direction is gradually narrowed on the downstream side.

9. A dry fluidized bed sorting device according to claim 8, wherein the number of separation promoting pieces located on the downstream side of said sorting deck is made smaller than that of separation promoting pieces located on the upstream side thereof.

10. A dry fluidized bed sorting device according to claim 1, wherein said separation plate is arranged on a downstream portion of said sorting deck at a certain height to be in approximately parallel to the bottom of said sorting deck.

11. A dry fluidized bed sorting device according to claim 10, wherein a tip end of said separation plate is arranged with an inclination to a line normal to a longitudinal axis of said sorting deck.

12. A dry fluidized bed sorting device according to claim 10, wherein an upstream-side end portion of said separation plate is formed to have a circular section.

13. A dry fluidized bed sorting device according to claim 5, wherein said sorting deck is constituted by a case body formed by joining vertical plates together along the respective sides of a hexagonal bottom plate made of stainless steel, and composed of a rectangular case body portion having an open top face and a trapezoidal case body portion, said bottom plate having an opening formed in a downstream end for discharging the deposits.

14. A dry fluidized bed sorting device according to claim 13, wherein said sorting deck is elastically supported at a plurality of portions by springs, and connected to a rotary disc rotationally driven by a motor at a position offset from the axial center of said rotary disc so as to be applied with an eccentric motion.

15. A dry fluidized bed sorting device according to claim 14, wherein said each separating promoting piece is constituted by a stainless steel plate, and five pieces of said separation promoting pieces are lined up in the width direction and arranged in three rows in the longitudinal direction in the rectangular case body portion of said sorting deck, while three pieces of said separation promoting pieces are lined up and arranged only in a row in the trapezoidal case body portion thereof.

16. A dry fluidized bed sorting device according to claim 15, further comprising:

a first screening device arranged below an opening formed in the downstream end of said separation plate and constituted by a case body applied with an eccentric motion and having a screen arranged on the bottom and having holes of a size enough to allow sand constituting the fluidized bed to pass through, and a first medium recover trough for recovering the said passed through said screen.

17. A dry fluidized bed sorting device according to claim 16, further comprising:

a second screening device arranged below said opening formed in the downstream end of the bottom plate of said sorting deck and constituted by a case body applied with an eccentric motion and having a screen arranged on the bottom and having holes of a size enough to allow sand constituting the fluidized bed to pass through, and a second medium recovery trough for recovering the sand passed through said screen.

18. A dry fluidized bed sorting device according to claim 1, wherein said separation promoting pieces are provided in the form of spaced projecting pieces which are spaced from one another, wherein a plurality of said spaced projecting pieces are provided along a first direction, and a plurality of said spaced projecting pieces are provided along a second direction, with said second direction orthogonal to said first direction, said spaced projecting pieces each including a first portion projecting upwardly from a bottom of said sorting deck and a second portion bent toward a downstream side of said sorting deck.

19. A dry fluidized bed sorting device according to claim 18, wherein a plurality of rows of said spaced projecting pieces are provided, and wherein each row extends in said second direction and includes plural spaced projecting pieces, a downstream row includes fewer projecting pieces than an upstream row, and said first portion of each of said projecting pieces is fixed to a head of a bolt, and wherein said bolt extends through said bottom of said sorting deck.

20. A dry fluidized bed sorting device according to claim 7, wherein the upstream-side end portion of said separation plate is formed to have a circular section having the same diameter as the thickness of said separation plate.

* * * * *